US006380674B1

(12) United States Patent
Aida et al.

(10) Patent No.: US 6,380,674 B1
(45) Date of Patent: Apr. 30, 2002

(54) X-RAY IMAGE DETECTOR

(75) Inventors: Hiroshi Aida, Otawara; Takashi Noji, Nasu-gun, both of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/486,375

(22) PCT Filed: Jul. 1, 1999

(86) PCT No.: PCT/JP99/03555

§ 371 Date: Feb. 28, 2000

§ 102(e) Date: Feb. 28, 2000

(87) PCT Pub. No.: WO00/02227

PCT Pub. Date: Jan. 13, 2000

(30) Foreign Application Priority Data

Jul. 1, 1998 (JP) ..... 10-186577
Dec. 25, 1998 (JP) ..... 10-369324

(51) Int. Cl.[7] ..... H01J 31/50
(52) U.S. Cl. ..... 313/525; 313/371; 313/532
(58) Field of Search ..... 313/365, 525, 313/328, 530, 371, 527, 528, 532, 523, 703 R

(56) References Cited

U.S. PATENT DOCUMENTS

| | | | | |
|---|---|---|---|---|
| 3,663,821 A | * | 5/1972 | Finkle | 313/65 |
| 4,041,343 A | | 8/1977 | Orthuber | |
| 4,300,046 A | | 11/1981 | Wang | 250/323 |
| 5,220,240 A | * | 6/1993 | Ohoshi et al. | 313/422 |
| 5,402,034 A | * | 3/1995 | Blouch et al. | 313/370 |
| 5,532,475 A | * | 7/1996 | Tonami et al. | 250/214 |
| 5,923,120 A | * | 7/1999 | Suzuki et al. | 313/532 |
| 5,986,387 A | * | 11/1999 | Nigakai et al. | 313/103 R |
| 6,320,181 B1 | * | 11/2001 | Nojoi et al. | 250/214 |

FOREIGN PATENT DOCUMENTS

| | | |
|---|---|---|
| DE | 31 50 257 | 6/1983 |
| EP | 0 006 267 | 1/1980 |
| FR | 2 226 749 | 11/1974 |
| GB | 1 405 256 | 9/1975 |
| JP | 53-63859 | 6/1978 |
| JP | 54-52462 | 4/1979 |
| JP | 60-182642 | 9/1985 |
| WO | WO 98/02021 | 1/1998 |

OTHER PUBLICATIONS

A. G. Knapp et al., "Large–area channel electron multiplier for CRT applications", IEE PROCEEDINGS, vol. 131, No. 1, Feb., 1984 (1984–02) pp. 6–9, XP002143105.

* cited by examiner

*Primary Examiner*—Sandra O'Shea
*Assistant Examiner*—Anabel Ton
(74) *Attorney, Agent, or Firm*—Pillsbury Winthrop

(57) ABSTRACT

The present invention provides an X-ray image detector (1) which can reduce the size of a whole apparatus associated with an X-ray imaging tube, reduce noise components of an output X-ray image even if an incident X-ray is very weak, and provide a distortion-free visible image or electric image. The X-ray image detector (1) comprises a vacuum container having an input fluorescent screen outputting fluorescent light, a photoelectric screen converting the fluorescent light which is output from the input fluorescent screen to a photoelectron, and an output fluorescent screen outputting a visible light image with the obtained electron, a plurality of image pick-up elements (3) arranged such that partially overlapped areas are outside an image taking area and taking the visible light image in a divided way, image processing circuits (4) so arranged as to correspond to the image pick-up elements and trimming a taken video signal, an output image processing circuit (6) obtaining a composed image and a display device (5) displaying it as one signal.

24 Claims, 10 Drawing Sheets

X-RAY IMAGE DETECTOR

This application is the national phase of international application PCT/JP99/03555 filed Jul. 1, 1999 which designated the U.S.

TECHNICAL FIELD

The present invention relates to an X-ray image detector for converting an image which is obtained from an X-ray being a radiation to an optical or electric image signal.

BACKGROUND ART

Generally, an X-ray is useful in the examination of an internal structure of a human body or an object and the apparatus for converting a penetration density distribution of an X-ray illuminating the human body and object, that is, the X-ray intensity distribution or X-ray image, to a visible light image or electric image signal corresponding to the X-ray have been extensively utilized.

As the apparatus for converting the X-ray image to a visible light image or electric image signal, an X-ray imaging tube (X-ray image intensifying tube) and X-ray vidicon (X-ray image detector) have been developed.

The X-ray imaging tube for intensifying an X-ray image signal and converting it to a visible light image comprises a vacuum container holding a vacuum therein, an input fluorescent screen arranged in the vacuum container and converting an X-ray which is incident from an outside to fluorescent light, a photoelectric screen arranged in the vacuum container and converting the fluorescent light which is exited from the input fluorescent screen to a photoelectron, an output fluorescent screen arranged in the vacuum container and converting, to a visible light image, the photoelectron from the photoelectric screen which is accelerated in response to an electric field provided by an acceleration electrode provided on an inner side, a metal layer stacked on the output fluorescent screen, and an output window holding the output fluorescent screen and through which the visible light image passes.

The above-mentioned X-ray imaging tube once converts an X-ray image which is incident on the vacuum container to a visible light image by the input fluorescent screen and, while accelerating a photo-electron by an electron lens after the visible light image has been converted to that photoelectron, reduces the size of the image to intensify it to a high energy and converts it once more back to a visible light image by the output fluorescent screen to obtain a brighter visible light image than the image obtained at the input fluorescent screen.

That is, the visible light image obtained by the photoelectric conversion of the X-ray image incident on the input fluorescent screen is very weak in intensity. By accelerating the photoelectron under an electric field from an acceleration electrode after the visible light image has been converted by a photoelectric screen to that photoelectron and, by doing so, intensifying the energy of the photoelectron to obtain a higher energy than an energy of an original X-ray image and, thereafter, once again converting it back to visible light by the output fluorescent screen, it is possible to obtain a more intensified visible light image than the original X-ray image.

In these days, in order to reduce the size of the apparatus, it has been proposed that an output section be made flat-like or an X-ray imaging tube be made to have features at the output section. For example, it has been proposed in U.S. Pat. No. 4,300,046 that an output fluorescent screen stacked over a transparent glass substrate be arranged parallel to an input fluorescent screen at a given spacing. It is to be noted that, in this structure, a proximity type electron lens is used.

In the structure disclosed in U.S. Pat. No. 4,300,046, the output fluorescent screen is formed integral with the glass substrate of a vacuum container and it is possible to directly acquire a visible light image from an outside without requiring an output window. Further, an X-ray image converted to a photo-electron is guided directly to the output fluorescent screen, so that the distortion of the image is reduced.

In JPN PAT APPLN KOKAI PUBLICATION NO. 61-62283, an X-ray image detector is disclosed having a circuit comprising thin-film photodiodes and thin-film transistors (TFTS) formed at a glass substrate and a fluorescent screen stacked over the circuit.

This X-ray image detector converts an incident X-ray image to light by a fluorescent screen, converts the light to an electric signal by the photodiode and takes the electric signal as image information to an outside by the TFT.

On the other hand, an example in which, in order to improve an S/N (signal to noise) ratio of an output image, a microchannel plate (MPC) for multiplying an electron is arranged in the X-ray imaging tube is suggested in U.S. Pat. No. 3,394,261.

The above-mentioned X-ray imaging tube can multiply a very weak X-ray image as an easily observable visible image and, since an electron lens is used to multiply (intensify) an X-ray image converted to a photoelectron, there arises a problem of an image distortion resulting from the electron lens. Further, a greater space is required for the electron lens and, as a result, the size of the X-ray imaging tube becomes greater, presenting a problem.

In the apparatus disclosed in U.S. Pat. No. 4,300,046, a proximity type electron lens is used and a smaller space is required than a structure using an ordinary electron lens, so that the size of the X-ray imaging tube can be made smaller. Further, it is recognized that there is less image distortion resulting from the. characteristic of the proximity type electron lens. Since, however, the proximity type electron lens cannot vary the size of an X-ray image converted to a photoelectron, it is difficult to, like the ordinary X-ray imaging tube as set out above, reduce the size of an electron image and, by doing so, enhance the energy density and improve the light strength per unit area of an output image. In comparison with the ordinary type X-ray imaging tube as set out above, the image luminance of an output is reduced to about 1/10 and, for use in a medical field, an X-ray amount with which the human body has to be irradiated is increased, thus presenting a problem of increasing an amount of X-ray exposed to the human body.

In the apparatus disclosed in JPN PAT APPLN KOKAI PUBLICATION NO. 61-62283, in spite of the fact that an X-ray image converted to an electric signal is a signal which is very weak in intensity, it is not multiplied until it is externally taken out and there arises a problem that more noise emerges on the output image. Although the X-ray image detector of a structure where an amplifying function is added in a TFT circuit has been proposed in JPN APT APPLN KOKAI PUBLICATION NO. 5-130510, etc., it is difficult to uniform the multiplication factor of the multiplying element given to all the pixels. This presents a problem of never improving an image quality over a whole image region.

It is possible, as reported in U.S. Pat. No. 3,394,261, to increase an image luminance of an X-ray image output by setting the MCP in the X-ray imaging tube, but in actual practice it is difficult to increase the size of the MCP. In the case where no consideration is paid to restricting the size of the X-ray imaging tube, it is possible to construct the X-ray imaging tube by increasing the magnifying power of the electron lens and to do so with the use of a smaller MCP. However, a larger space is required for the electron lens, thus offering a problem not suited to a practical application.

DISCLOSURE OF INVENTION

It is accordingly the object of the present invention to provide an X-ray image detector which can reduce the size of a whole apparatus associated with an X-ray imaging tube, reduce noise components of an output X-ray image even if an incident X-ray is very weak and obtain an output image of an X-ray image of a larger area not involving an image distortion containing an adverse effect resulting from a moire, etc.

The present invention is achieved based on the above-mentioned problem and provides an X-ray image detector comprising a vacuum container holding a vacuum therein; an input fluorescent screen arranged in the vacuum container and converting an X-ray which is incident from an outside to fluorescent light; an output fluorescent screen arranged in the vacuum container and generating a visible light image by an electron accelerated under an electric field; a metal layer stacked on the output fluorescent screen; an output window holding the output fluorescent screen and allowing the visible light image to pass therethrough; and wherein the input fluorescent screen and output fluorescent screen are arranged parallel to each other while maintaining a predetermined spacing; an electron multiplier is arranged between the input fluorescent screen and the output fluorescent screen, the electron multiplier has a plurality of metal plates of a predetermined thickness having a plurality of through holes opened and a plurality of insulating materials having gaps to allow a photoelectron from the through hole to pass therethrough are alternately stacked; and image pick-up element is arranged in a position allowing a visible light image from the output fluorescent screen to be received past the output window and takes, as a video image, image information which is output to the output window.

BEST MODE OF CARRYING OUT THE INVENTION

With reference to the drawings, the embodiments of the present invention will be explained in more detail below.

Figure 1:
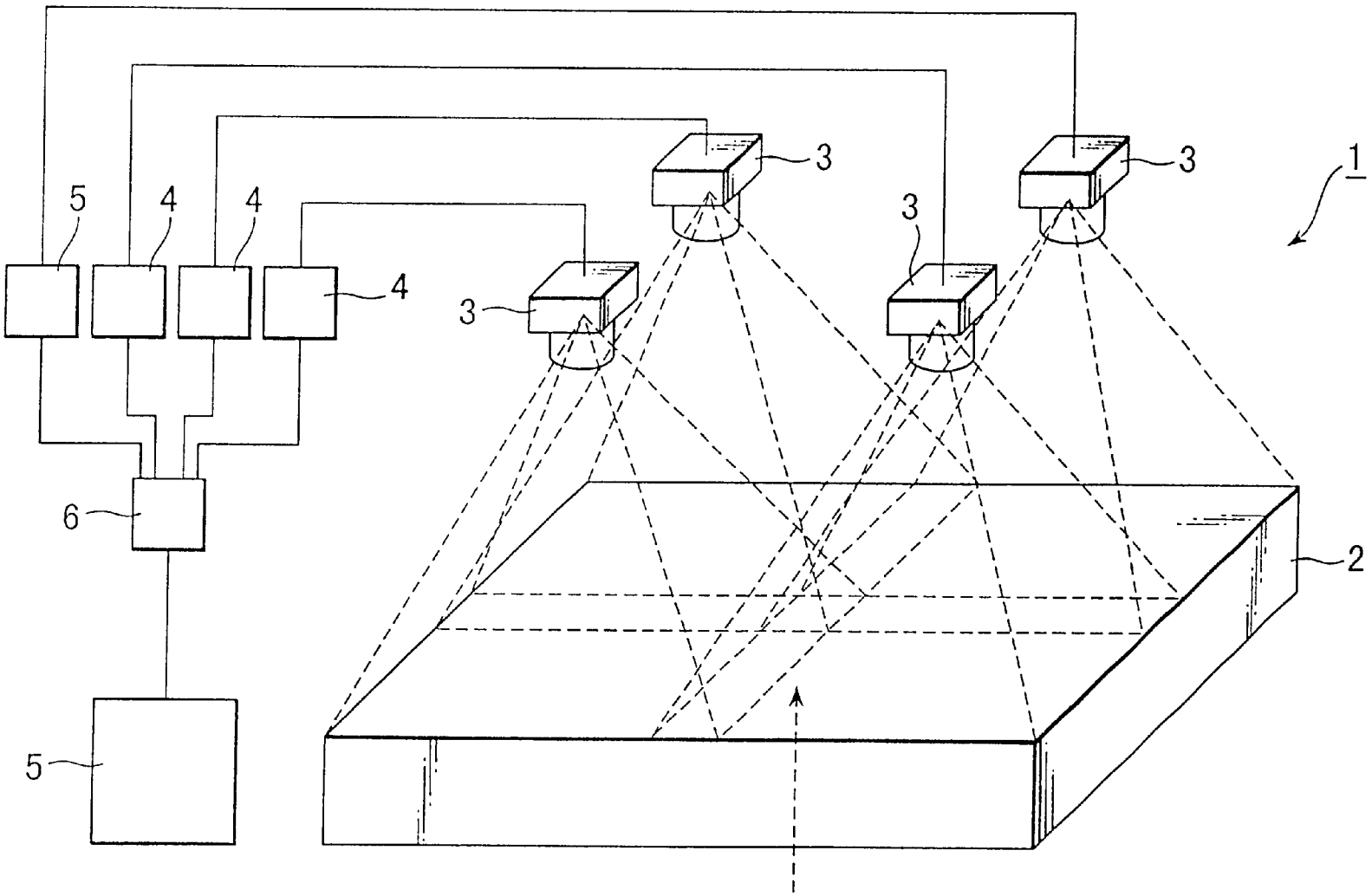
FIG. 1 is a diagrammatic view showing one example of an X-ray image detector associated with one embodiment of the present invention.
Figure 2:
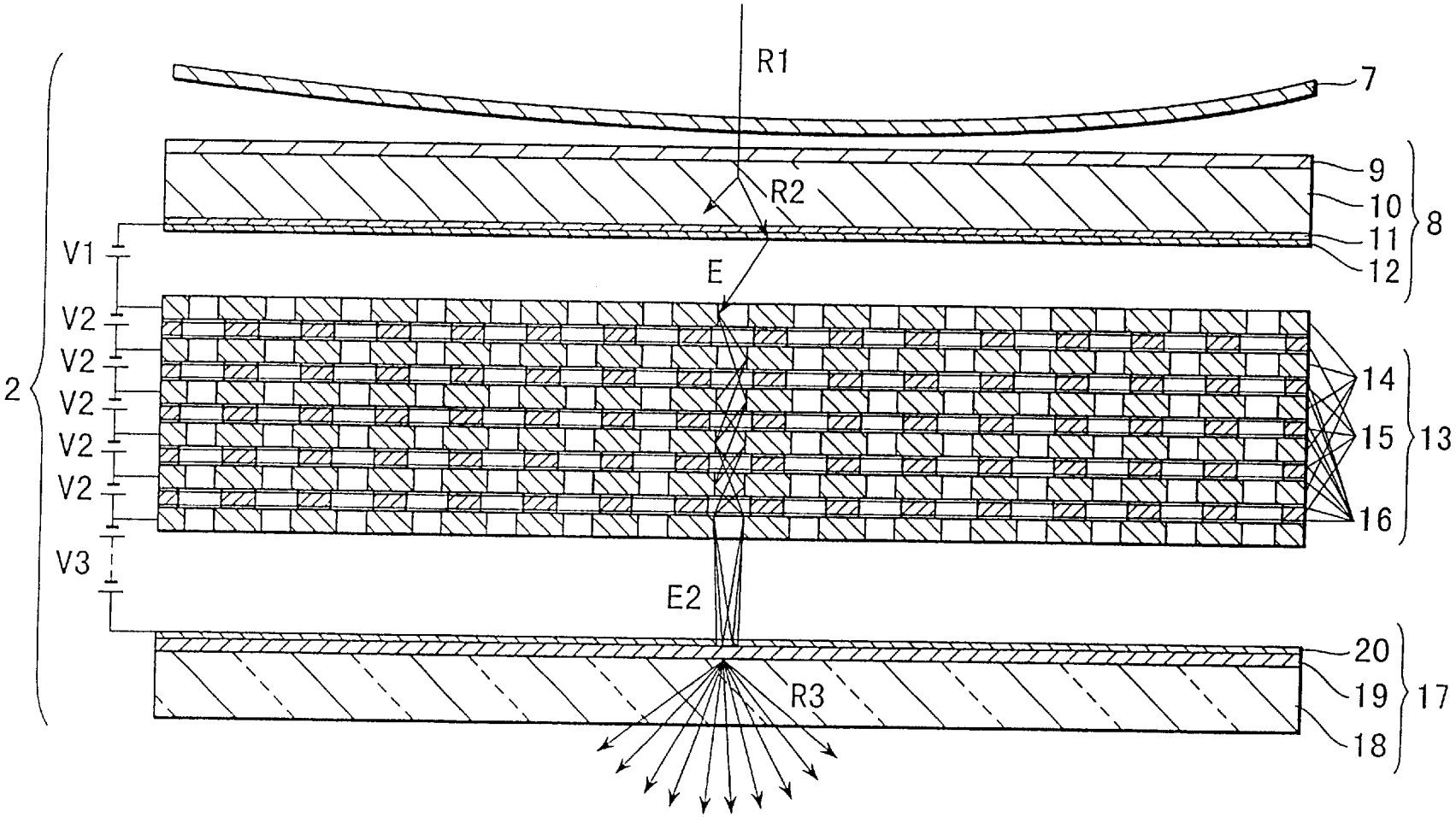
FIG. 2 is a diagrammatic view showing one example of an interior of a vacuum container of an X-ray image detector shown in FIG. 1.

FIG. 1 is a general whole view showing a general arrangement of an X-ray image detector to which the embodiment of the present invention is applied;

As shown in FIG. 1, the X-ray image detector 1 comprises a vacuum container 2 catching an X-ray image, that is, an X-ray passing through a to-be-detected object such as a human body and outputting a visible light image through a light-electron conversion and electron-light conversion, a plurality of image pick-up elements 3 taking, as image information, a visible light image output to an output fluorescent screen as explained at a subsequent stage with the use of FIG. 2 of the vacuum container and outputting video signals corresponding to the image information, image processing circuits 4 applying predetermined image processing to the video signals output from the respective image pick-up elements 3, and an output signal processing circuit 6 eliminating an overlapped image portion (two-and 4-fold overlapped portions as shown in FIG. 1) from processed image signals from the image processing circuits 4, or correcting a discontinuous image, and constructing an image signal for display. It is to be noted that the image signal for display which is output from the output signal processing circuit 6 is displayed on a display device 5 as a visible image observable by the eye of the utilizer.

FIG. 2 is a diagrammatic view showing a structure of a visible light image output section provided at an end of the vacuum container 2 of the X-ray image detector 1 as shown in FIG. 1, that is, and X-ray image-visible light image conversion section provided within the vacuum container 2.

As shown in FIG. 2, an X-ray R radiated from an X-ray source, not shown, passes through the to-be-detected object, such as the human body, and is given a density distribution as an X-ray $R_1$ and is incident on an input fluorescent screen 8 after passing through an input window 7 comprised of high X-ray transmittance metal plates of a predetermined thickness, such as an Al (aluminum) plates or Ti (titanium).

The input fluorescent screen 8 has a CsI (an input fluorescent film of cesium iodide, hereinbelow simply referred to as a CsI film) 10 of a predetermined thickness on an input substrate 9 of, for example, aluminum, and a transparent conductive film 11 such as an ITO (indium tin oxide thin film) of a predetermined thickness formed on a surface of the CsI film 10 opposite to the input substrate 9 and a photoelectric screen 12 stacked on a surface of the transparent conductive film 11 opposite to the CsI film 10 and formed of Sb (tin), K (potassium), Cs (cesium) or Na (sodium), etc., and is incident on the CsI film 10 past the input substrate 9 and converted to fluorescent light $R_2$ in the CsI film 10. The fluorescent light $R_2$ moves from the CsI film 10 toward the transparent conductive film 11 side, reaches the photoelectric screen 12 past the transparent conductive film 11, is converted to a photoelectron E by the photoelectric screen 12 and it is radiated into a vacuum.

The photoelectron E is accelerated by a potential difference $V_1$ applied between the transparent conductive film 11 and an electron multiplier 13 and reaches the electron multiplier 13.

The electron multiplier 13 is comprises of an alternate stack array of metal plates 14 of a predetermined thickness, such as soft iron or invar alloy (Ni 36 Fe 64), having a plurality of through holes opened at predetermined intervals in a surface direction and insulating materials 15 comprised of glass plates of a predetermined thickness having a plurality of through holes positioned in an one-on-top-of-another relation to the through holes, in the metal plates 14 in a thickness direction of the through holes, that is, as explained with the use of FIG. 2, with respect to a direction from the input substrate 14 to a direction toward an output fluorescent screen as will be described below. And the metal plate 14 and glass plate 15 are joined by a frit glass 16 of a lower melting point to each other. It is to be noted that the electron multiplier 13 is arranged parallel to the input fluorescent screen 8.

Across the respective metal plates 14 a potential difference of a magnitude indicted by $V_2$ is applied. The photoelectron E radiated from the photoelectric screen 12 of the input substrate 9 and reaching the electron multiplier 13 impinges on the inner wall of the through hole in the metal plates 14 constituting the electron multiplier 13 and, through a secondary electron multiplication phenomenon, generates one or more electrons E2. The generated electron E2 is accelerated toward the next stage one of the plural metal plates 14 by a potential difference $V_2$ applied across the corresponding metal plates 14 and again impinges on the inner wall of the through hole in the metal plate and, through the secondary electron multiplication phenomenon, generates one or more electrons E2.

Through such impinging and generation of secondary electrons in a repeated way, the photoelectron E incident on the electron multiplier 13 is gradually multiplied and radiated from the electron multiplier 13 toward an output fluorescent screen 19 of an output screen 17. At this time, an amount of electrons E2 radiated is proportional to an amount of incident photoelectrons E and depends upon the material of the metal plate 14, thickness of the metal plate 14, configuration of the holes in the metal plate 14, thickness of the glass plate 15 and electric field created according to a potential difference $V_2$ applied across the glass plate 15 and the metal plate 14 and the multiplication factor is determined by the number of layers of the stacked metal plates 14.

Therefore, any multiplication factor can be obtained by optimally setting the property of the metal plate 14, number of the metal plates 14, thickness of the metal plate 14, configuration of the holes in the metal plates 14, thickness of the glass plate 15, and potential difference $V_2$ applied across the glass plate 15 and the metal plate 14.

The electron $E_2$ radiated from the electron multiplier 13 is accelerated by a potential difference $V_3$ applied between the electron multiplier 13 and an output fluorescent film 19 in an output fluorescent screen 17 constituting a part of the vacuum container 2 and comprising an output window 18 formed of, for example, transparent glass, output fluorescent film 19 of a predetermined thickness provided on the electron multiplier 13 side of the output window 18 and light reflective metal layer 20 provided on the electron multiplier 13 side of the output fluorescent film 19 and formed of, for example, aluminum and reaches an inside of the output fluorescent film 19 past the metal layer 20.

The electron $E_2$ reaching the inside of the output fluorescent film 19 is converted to visible light $R_3$ having a luminance corresponding to an energy obtained from the potential difference $V_3$ and it is output as a visible light image toward on outside of the vacuum container 2, that is, toward the corresponding image pick-up element 3. That is, the X-ray $R_1$ incident on the vacuum container 2 is multiplied in the vacuum container 2 and output as the visible light image $R_3$ to an outside of the vacuum container 2.

The visible light image $R_3$ is output as a visible light image equal in magnifying factor to one incident on the vacuum container 2.

The visible light image output from the vacuum container 2, that is, the visible light image projected on the output window 18, is taken, by the plurality of image pick-up elements such as CCD cameras 3 as already explained with the use of FIG. 1, with partial image areas overlapped, and input as a video signal to the corresponding image processing circuit 4 and the image signal is temporarily stored in a memory element in the image processing circuit 4.

In the output signal processing circuit 6 the position information of overlapped areas of the image of the output window 18 taken by the respective CCD camera 3 is stored and, out of the image information stored in the respective image processing circuit 4, image information of those areas not taken in an overlapped way is read out in accordance with the information. And image information of an area taken by two or more CCD cameras is such that, by reading out only the image information from only one of those image processing circuits 4 storing the image information of the overlapped areas, the image of the output window 18 taken by the respective CCD camera 3 is taken out as image information of a not-overlapped area.

Thereafter, in the output image processing circuit 6, the image information read out from the image processing circuit 4 is composed and reconstructed into one two-dimensional image and a video signal projected onto a whole output fluorescent film 19 is displayed as a video image on the display device 5 without any discontinuous points. By picking up the visible light image projected onto the output window 18 by a plurality of CCD cameras in a mutually partly overlapped way it becomes unnecessary to position the CCD cameras. Further, by taking the visible light image of the output window 18 in a divided way with the use of a plurality of CCD cameras 3 it is possible to achieve less of a space necessary to an optical lens for taking the visible light image and to reduce the size of the detector as a whole and, in particular, reduce the depth of it. High in cost is an optical lens capable of taking a visible light image of a greater area without being deformed. And it is also hard to obtain an optical lens capable of imparting an uniform optical characteristic to a whole area. In this situation, picking up the visible light image projected on the output window 18 in a divided way can reduce the cost of the X-ray image detector.

Further, as the method for preparing the electron multiplier 13 a glass plate or ceramic plate, or photosensitive organic films and metal plates having many holes opened by a chemical or physical etching, are alternately stacked and joined. It is, therefore, possible to readily prepare a large-sized electron multiplier.

Figure 3:
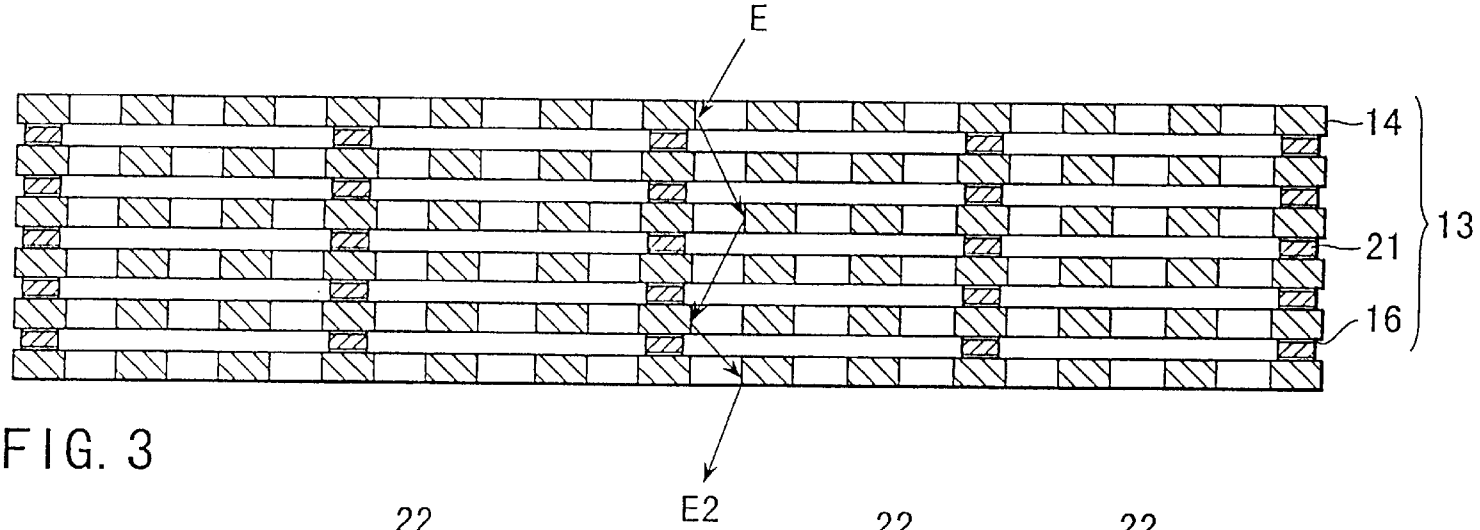
FIG. 3 is a diagrammatic view for explaining another embodiment of an electron multiplier shown in FIG. 2.

FIG. 3 is a diagrammatic view showing another embodiment of the electron multiplier 13 shown in FIG. 2.

As shown in FIG. 3, the electron multiplier 13 is such that metal plates 14 of a predetermined thickness have a plurality of through holes opened at predetermined intervals in a surface direction and insulating materials 21 are comprised of glass columns 21 of a predetermined size and arranged at any given positions in the surface direction of the metal plate 14 and these metal plates are arranged with each glass column 21 interposed, the glass plate and glass column being fixed by frit glass 16. According to this structure, less contact area is ensured between the respective metal plate 14 and the glass column 21 and the glass column has a small volume, so that it is possible to suppress, to a low extent, the level of a leak current produced between the mutual metal plates 14 and to reduce the capacity of a power source device, not shown, for providing a potential difference $V_2$ between the metal plates 14. Further, in comparison with the method using the glass plate 15 shown in FIG. 2, a simpler positioning operation is ensured in aligning the through hole of the glass plate 15 and that of the metal plate 14. This makes it possible to provide a lenient allowance value between the manufacturing accuracy of the through holes in the glass plate 15 and that of through holes in the metal plate 14 and hence to reduce the costs of component parts involved.

Figure 4:
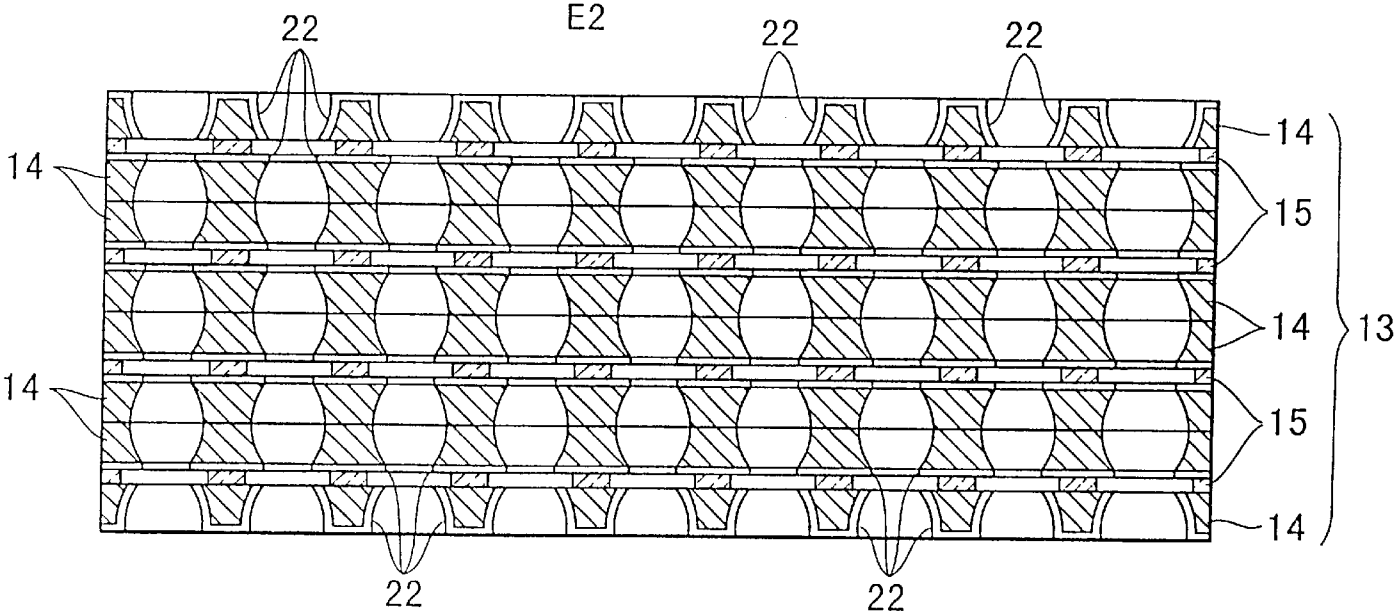
FIG. 4 is a diagrammatic view for explaining another embodiment of an electron multiplier shown in FIG. 2.

FIG. 4 is a diagrammatic view showing another embodiment of the electron multiplier 13 shown in FIGS. 2 and 3. Since the basic structure is substantially the same as that shown in FIG. 2, only the featuring points will be explained in more detail below.

As shown in FIG. 4, this electron multiplier 13 has a stacked layer structure comprising metal plates 14 of a predetermined thickness having a plurality of through holes opened, by a chemical etching, at predetermined intervals in a surface direction and glass plates 14 having a plurality of through holes provided at intervals substantially equal to those of the through holes in the metal plates 14 in a surface direction, provided in number nearly equal to the number of the through holes in the metal plate 14 and defined as being larger in diameter than the through holes in the metal plate 14, the metal plates being stacked in one or two layer units while maintaining a metal-plate-to-metal-plate insulation by the glass plate. In this connection it is to be noted that the glass plate 15 and metal plate 14 are fixed together by frit glass 16.

As evident from FIG. 4, the metal plates 14 are stacked in two layer units except the metal layer nearest to an input fluorescent screen 8 and that nearest to the output fluorescent screen 17. The two metal sheets 14 in respective two layer units are so stacked that the larger diameter hole side faces are set in contact with each other, that is, their larger diameter hole side faces of the respective through holes are set in a face-to-face relation, noting that the through hole is so chemically etched as to have its hole diameter formed as a larger diameter hole side face at a start-of-etching side and its hole diameter formed as a gradually decreasing diameter hole side face in a depth direction, a feature of chemically etching a hole. On the other hand, each one metal sheet 14 (nearest to the input fluorescent screen 8 and output fluorescent screen 17) in proximity to the input fluorescent screen 8 and output fluorescent screen 17 is so arranged as to have its larger diameter hole side face facing the fluorescent screen 8(17).

On a predetermined surface of the metal sheet 14 at the respective end, an insulating material of, for example, a silicon oxide is formed as the insulating layer 22 by a CVD technique, etc. It is to be noted that the area where the insulting layer 22 is formed on the metal plate 14 at the respective end is a surface on a side facing the input fluorescent screen 8 or the output fluorescent screen 17 as shown in FIG. 4. Thus the insulating layer 22 is formed on a whole area in a cross-sectional (depth) direction of the through holes formed by the chemical etching in the metal plate 14 nearest to the input fluorescent screen 8 and output fluorescent screen 17 and on or just near a flat portion on the metal plates 14 stacked in two layer units except at those cross-sectional direction portion of the through hole formed by the chemical etching.

According to the electron multiplier 13 shown in FIG. 4, the insulating layer 22 is formed on the surface of the metal plate 14 on the side facing the input fluorescent screen 8 or the output fluorescent screen 17 and, by doing so, it is possible to reduce the thickness of the glass plate 15 provided between the metal plates 14 and eventually to reduce the thickness of the electron multiplier 13. Hence, if the whole thickness of the electron multiplier 13 is given to be equal it is possible to improve the multiplication factor. Further, due to the insulating layer 22 being provided on the metal plates 14, the broadening of electrons passing through the electron multiplier 13 (a displacement between a position of an entrance into the electron multiplier 13 and a position of an exit from the electron multiplier) is reduced and an image resolution is improved.

Figure 5:
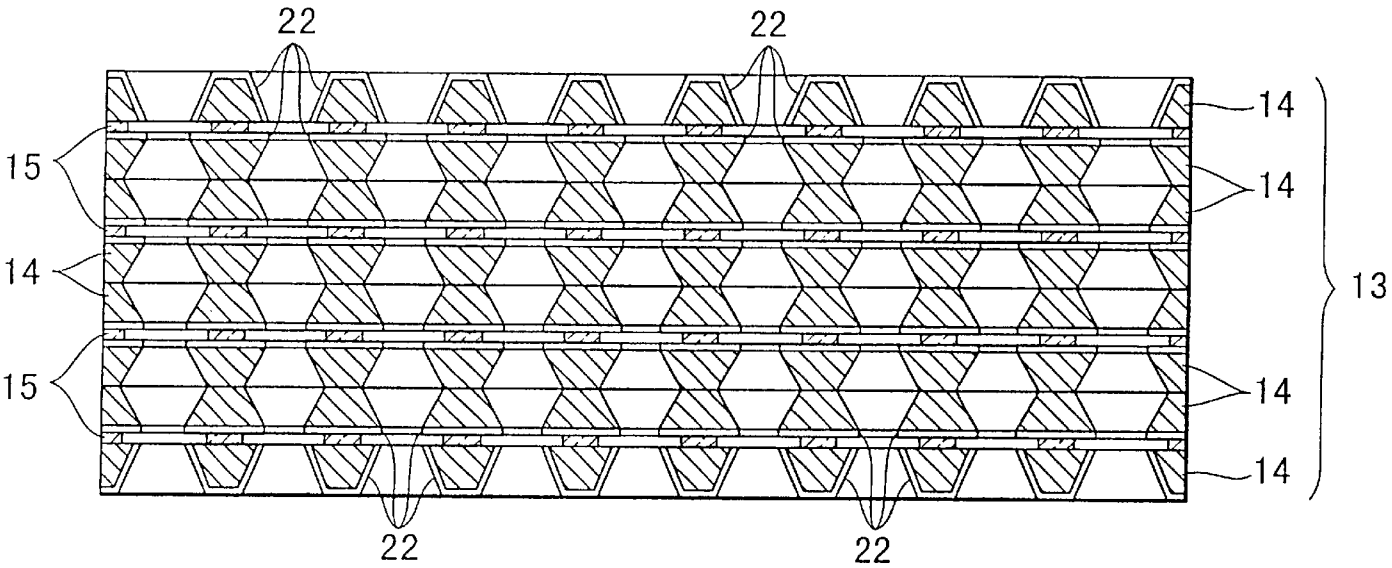
FIG. 5 is a diagrammatic view for explaining another embodiment of the electron multiplier shown in FIG. 4.

FIG. 5 is a diagrammatic view showing a variation of the electron multiplier 13 shown in FIG. 4.

As shown in FIG. 5, the electron multiplier 13 has a stacked layer structure having metal plates 14 of a predetermined thickness having a plurality of through holes opened at predetermined intervals in a surface direction by a machining process, such as drilling, and glass plates 15 having a plurality of through holes provided at intervals nearly equal to those of the through holes in the metal plates 14 in a surface direction, provided in number equal to the through holes in the metal plates 14 and defined as being larger in diameter than the through holes in the metal plates 14 and the metal plates being stacked in one or two layer units while maintaining a metal-plate-to-metal-plate insulation. The through holes in the metal plates 14 differ in size between one hole side face the other hole side face and have a tapered cross-section configuration similar to a countersunk hole as viewed in a nearly straight direction.

The metal plates 14 are stacked in two layer units except those nearest to the input fluorescent screen 8 and output fluorescent screen 17. It is to be noted that the metal layers in such two layer units are stacked with their larger diameter hole side faces set in a mutually adjacent relation such that the faces of the two layers are inverted in every other layer. The metal plates (those nearest to the input fluorescent screen 8 and output fluorescent screen 17), one near to the input fluorescent screen and the other near to the output fluorescent screen 17 are so arranged that the large diameter hole side face confronts the fluorescent screen 8(17).

An insulating layer 22 of an insulating material, such as silicon oxide, is formed, by a CVD technique, etc., on a predetermined surface of the metal plate 14. An area of the metal layer 14 on which the insulating layer 22 is formed is, in any case, a surface on a side facing the input fluorescent screen 8 or output fluorescent screen 17 as evident from FIG. 5. The insulating layer 22 is formed on the whole cross-sectional (depth) area in the through holes in the metal layers 14 nearest to the input fluorescent screen 8 and output fluorescent screen 17 and on only those flat portions of the respective two-layer metal plates 14 other than the cross sectional direction of the through holes.

According to the electron multiplier 13 shown in FIG. 5, since the insulating layer 22 is formed on the side of the metal plate 14 facing the input fluorescent screen 8 or the output fluorescent screen 17, it is possible to reduce the thickness of the glass substrate 15 provided between the metal plates 14 and eventually to reduce the thickness of the electron multiplier 13. As a result, the whole thickness of the electron multiplier 13 being given to be equal, it is possible to improve the multiplication factor. By the insulating layer 22 provided on the metal plate 14 the broadening (a displacement between the position of the photoelectron entering into the electron multiplier 13 and the position of it exiting from the electron multiplier 13 when the photoelectron passes through the electron multiplier) of photoelectrons passing through the electron multiplier 13 is reduced and the image resolution is improved.

Figure 6:
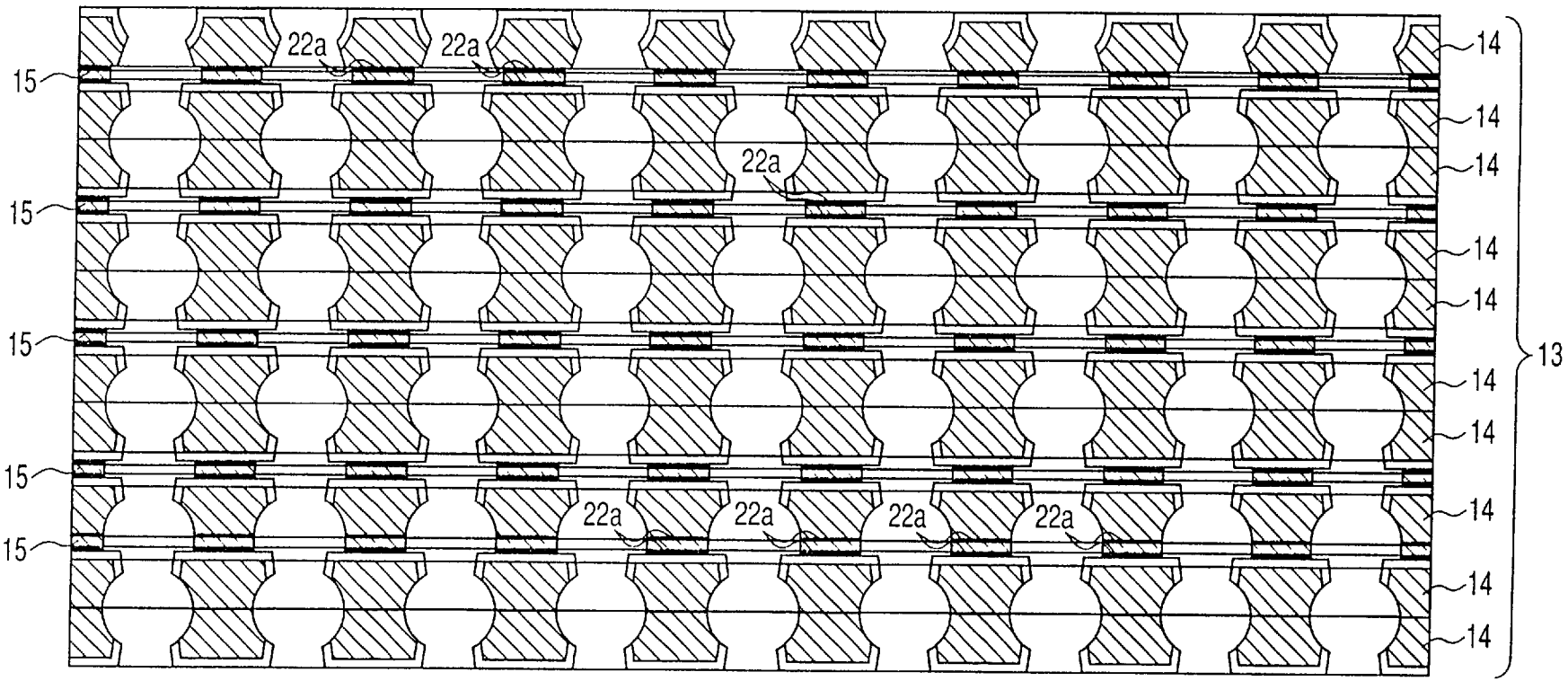
FIG. 6 is a diagrammatic view for explaining another embodiment of the electron multiplier shown in FIG. 4.

FIG. 6 is a diagrammatic view showing another example of the electron multiplier of FIGS. 4 and 5. In the structure shown in FIG. 6, two metal plates 14 are added to an output fluorescent screen 17 side through the insulating layer 22 and insulating bonding agent 22*a* in the electron multiplier 13 shown in FIGS. 4 and 5. By properly setting a voltage applied to a single metal plate near to the output fluorescent screen 17 and voltage on the added two metal plates 14 the track of electrons radiated from the electron multiplier 13 is readily controlled in comparison with the examples of FIGS. 4 and 5 and it is possible to suppress the scattering of electrons between the electron multiplier 13 and the output fluorescent screen 17 and to improve the resolution of the image.

Figure 7:
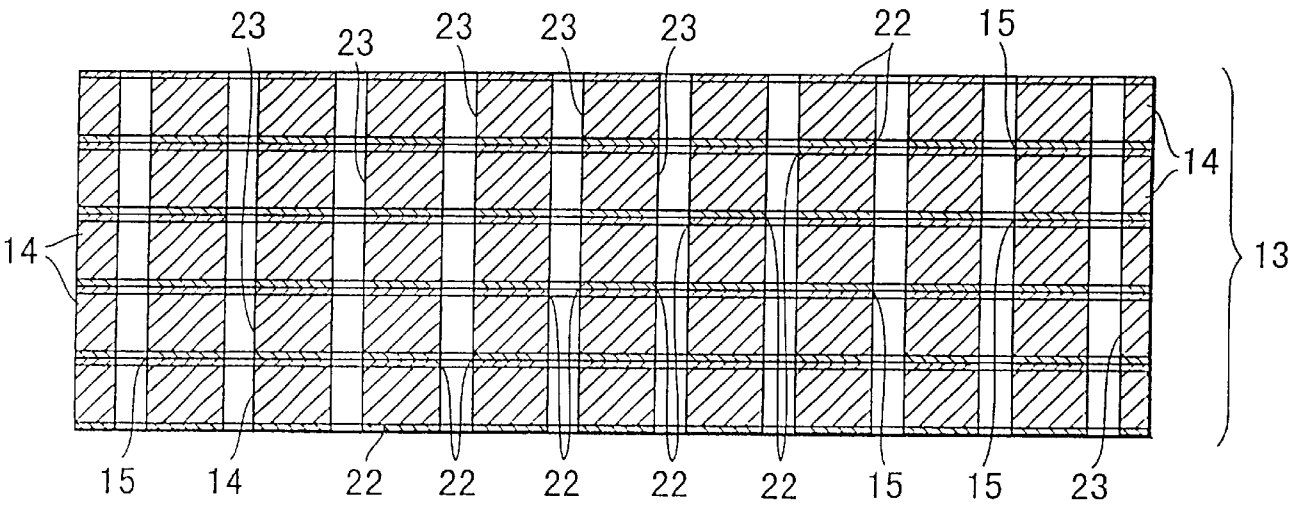
FIG. 7 is a diagrammatic view for explaining another embodiment of the electron multiplier shown in FIG. 2.

FIG. 7 is a diagrammatic view showing another embodiment of the electron multiplier 13 shown in FIGS. 2 to 6.

As shown in FIG. 7, the electron multiplier 13 is such that a predetermined number of metal plates 14 having an insulation layer 22 at both surfaces are stacked as a layer structure through a glass plate 15. Through holes 23 in the metal plates (including the insulating layers 22) and glass plates 15 are such that a plurality of through holes are formed, by drilling or laser beam machining process, with a predetermined number of metal plates 14 and glass plates 15 set in a stacked-layer state.

According to the structure shown in FIG. 7, it is not necessary to positionally align the openings in the glass plates 15 with the through holes in the metal plates 14 in comparison with the structures as shown in FIGS. 2 to 5. Since the opening step can be reduced to once, it is possible to largely reduce the manufacturing cost at the manufacture of the electron multiplier 13.

As set out above, according to the present invention, in an X ray image detector constituted by the electron multiplier and comprising, in the vacuum container, an input fluorescent screen for converting an X-ray to light, an output fluorescent screen constituting part of the vacuum container and including a transparent glass plate and metal plates having through holes between the input fluorescent screen and the output fluorescent screen and providing a stacked layer structure with the insulating material such as glass interposed between the metal plates, a visible light image projected on the glass plate of the vacuum container is taken by a plurality of CCD cameras with image pick-up areas partly overlapped and, by eliminating a signal portion of the overlapped areas from an obtained image signal, a composition is made. This makes it unnecessary to perform an exact positioning of the CCD camera. By taking a projected light image on the output window in a divided form by the CCD cameras it is possible to achieve less of a space necessary for an optical lens to take the visible light image and to reduce the size of the apparatus as a whole. It may be said that an optical lens capable of taking a visible light image of a greater area without deformation is expensive and further it is not always possible to obtain a uniform optical characteristic over a whole area. Therefore, taking a projected visible image on the output window can reduce a cost of the X-ray image detector as a whole and improve the quality of a picked-up image.

Figure 8:
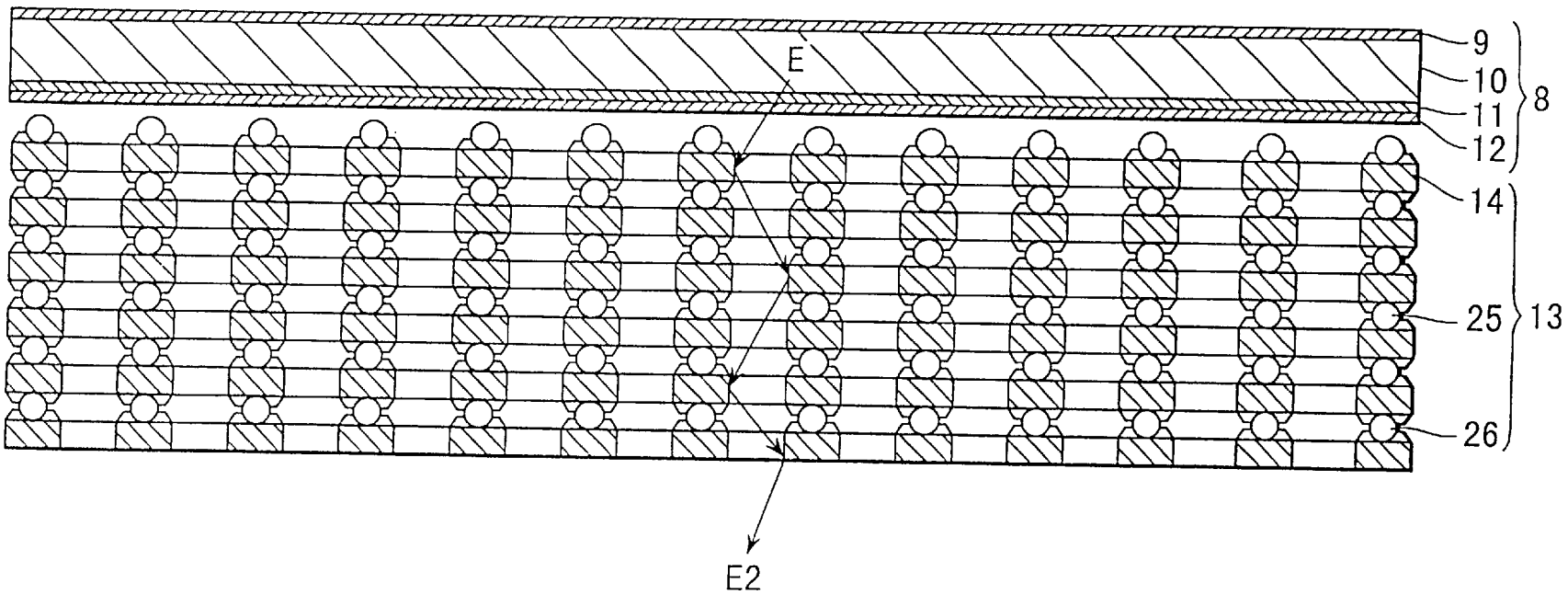
FIG. 8 is a diagrammatic view for explaining another embodiment of the electron multiplier shown in FIG. 2.

FIG. 8 is a diagrammatic view showing still another embodiment of the electron multiplier 13 shown in FIGS. 2 to 7. The basic structure is substantially the same as that shown in FIG. 2 and a detailed explanation will be made only about the featuring points below.

As shown in FIG. 8, an electron multiplier 13 constructs a stacked layer structure, comprising metal plates 14 of a predetermined thickness having a plurality of metal plates 14 opened at predetermined intervals by a chemical etching in a surface direction and glass beads 24 and frit glass 25 (the structure using the frit glass is the same as that shown in FIG. 4, but use is made of a plurality of glass bead spheres). Further, a plurality of glass beads 24 are fixed by the frit glass 25 to surface portions of the metal plates on the photoelectric screen 12 side. Incidentally, the photoelectric screen 12 and glass beads 24 are not joined so as to prevent any adverse influence from being exerted on the photoelectric screen of a high sensitivity.

In the electron multiplier 13 thus structured, even if an interval between the photoelectric screen 12 directed to the electron multiplier 13 side and the electron multiplier 13 approaches to a more than mechanical precision extent, a clearance between the photoelectric screen 12 and the nearest one of the metal plates 14 of the electron multiplier 13 to the photoelectric screen 12 is positively maintained by the glass beads 24, so that a stable function is ensured without any breakdown occurring.

By doing so, the potential difference produced between the photoelectric screen 12 and the electron multiplier 13 can be stably set and the spacing between the photoelectric screen 12 and the electron multiplier 13 can be set closer to a spacing controlled with mechanical accuracy. As a result, it is possible to lower the electric field intensity acting between the photoelectric screen 12 and the metal plate 14 on the photoelectric screen 12 side which is nearest to the electron multiplier 13. By doing so, the broadening of the track of a photoelectron E radiated from the photoelectric screen 12 is suppressed, so that the image resolution can be prevented from being deteriorated and hence an image quality is improved.

Figure 9A:
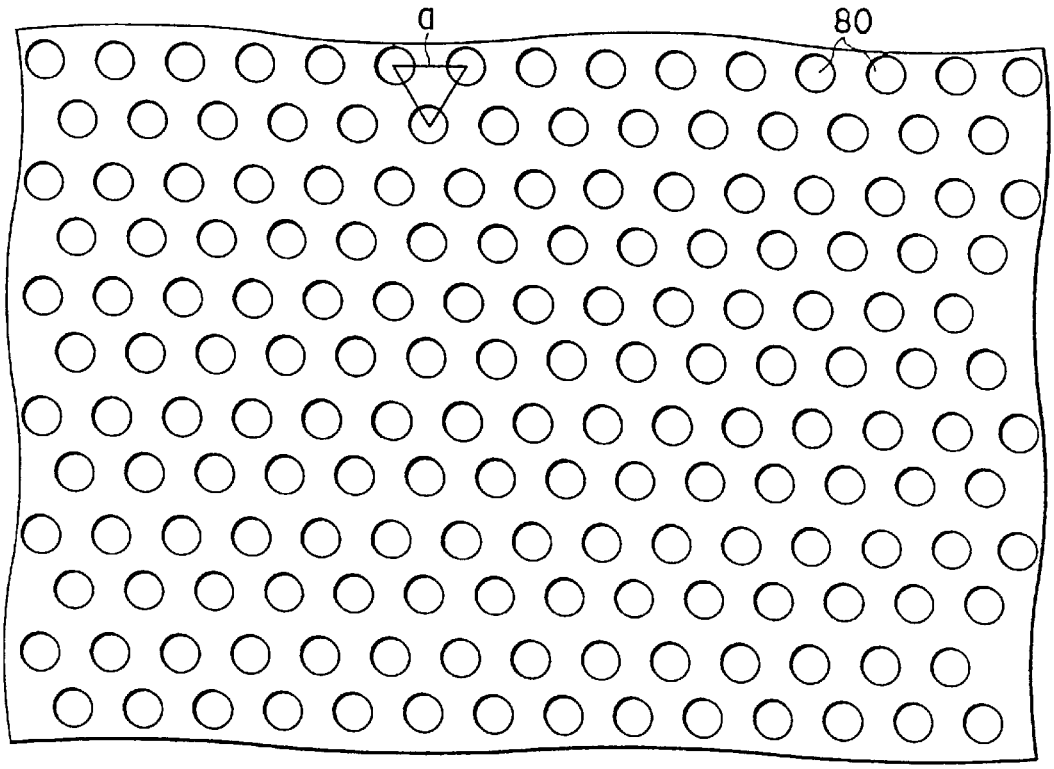
FIGS. 9A and 9B are diagrammatic views showing one example of an array pattern of through holes in the electron multiplier and array pattern of pixels of a CCD sensor associated with the electron multiplier shown in FIGS. 2 to 8.
Figure 9B:
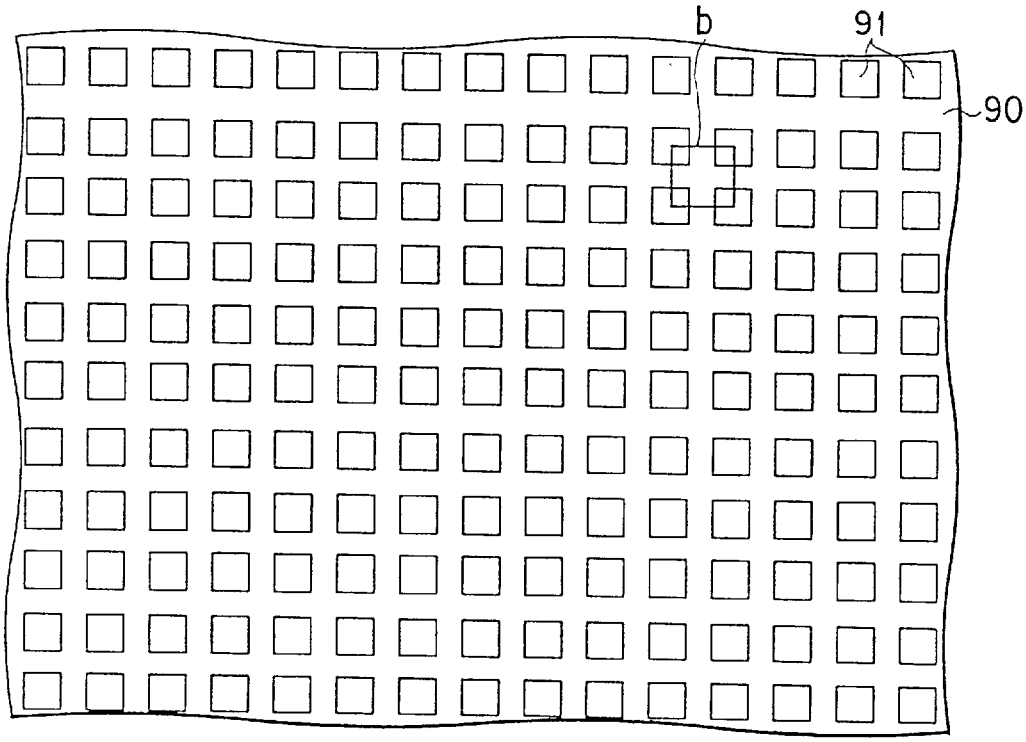

FIGS. 9A and 9B are diagrammatic views for explaining a relation of a state of an opening array in the electron multiplier as shown in FIGS. 2 to 8 to a state of a pixel array of CCD sensors of the CCD cameras.

The electron multipliers as shown in FIGS. 2 to 8 have a stacked layer structure having metal plates and insulating materials sequentially stacked and having a plurality of holes provided at predetermined intervals as shown in FIG. 9A. That is, a photoelectron from an X-ray image incident on the input fluorescent screen passes through the through hole in the electron multiplier while being amplified an is converted to a discrete two-dimensional image comprised of minute dots corresponding to an array of through holes in the electron multiplier. At this time, the photoelectron amplified by the electron multiplier 13 is output at each through hole and a visible light image output on the output window is output as a collective dot group having a correlation to the array of through holes in the electron multiplier. Thus, the minimum value of the resolution of an output image corresponds to a spacing between the mutual through holes in the electron multiplier.

Incidentally, each pixel of the CCD sensor is nearly rectangular in configuration as shown in FIG. 9B and a two-dimensional image output past the electron multiplier is picked up in a form divided in CCD sensor's pixel units when an image is taken with the CCD camera having a CCD sensor.

If, therefore, a positional (array) displacement occurs between the dot position (array) of an X-ray image converted by the electron multiplier to a dot collective group and the position (array) of the pixels of the CCD sensor, a light amount incident on the respective pixel of the CCD sensor varies, an uneven luminance appears on a final output image. This phenomenon is generally known as a moire and it is generated as a periodic pattern occurring due to the array of the through holes in the electron multiplier as shown in FIGS. 2 to 8 and the array of the pixels of the CCD sensor and pixel intervals.

By this moire, an image defect is partially generated on the output image output from the CCD sensor and an extreme uneven density is generated, so that an image quality varies extremely. It is, therefore, necessary to make the array of through holes in the electron multiplier a best array when the electron multiplier as shown in FIGS. 2 to 8 is manufactured.

Now an explanation will be made below about the extent of the moire produced when the electron multiplier and CCD sensor are stacked.

As set out above, the resolution of an image projected on the output window is determined by the intervals of the through holes in the electron multiplier and, in order to heighten the image resolution, it is necessary that the interval between the mutual through holes be made minimal.

In many cases, the through holes in the electron multiplier are formed with a close-packed right triangle array as a base so as to make their member per unit area maximal as shown in FIG. 9A.

On the other hand, the light receiving surface of the CCD sensor is such that, as explained with the use of FIG. 9B, the respective light receiving elements are nearly rectangular and, in order to make later image processing readier, an orthogonal array is used with a square substantially as a base.

It is to be noted that, in an ordinary CCD sensor, there is an area between the pixels where incident light cannot be detected. And the light incident on that area is not output as an image signal.

Under such condition it is required that, in order to pick up an output image with a high resolution, the interval of through holes in the electron multiplier, image light of a magnifying power given by a passed lens system and the pixel interval of the light receiving surface of the CCD sensor be nearly matched. It is, however, difficult to accurately positionally align all the pixels of the CCD sensor with all the through holes of the electron multiplier over the whole image. Due to the positional displacement, those dots guided in the pixels of the CCD sensor and those dots guided in other areas, that is, non-light-detected areas, are periodically generated due to a misalignment and, since there occurs a dropout of image information possessed by those dots guided in the non-light-detected areas, more fringes are mixed into an output image. This means that the resolution and information amount of an image picked up by the CCD sensor will be deteriorated in proportion to the resolution and image information amount output from the electron multiplier.

When the extent of generation of moire fringes exceeds a limitation value, a visible light image output from the electron multiplier cannot be converted to an electric signal over a whole image range and, to the extent of generation of the moire fringes and at the occurrence of the moire fringes, it is important that their interval be made as small as possible. At that time, the factor of deciding the interval of the moire fringes is, as set out above, the dot array of an image output from the electron multiplier, that is, the array of the through holes in the electron multiplier and their intervals and the array of pixels of the CCD sensor and their interval. In order to achieve readier image processing, it is required, as set out above, that the pixel array of the CCD sensor be square-lattice-like. Further it is requested that the interval of the pixels of the CCD sensor be a value corresponding to the mutual interval of the through holes in the electron multiplier.

Figure 10A:
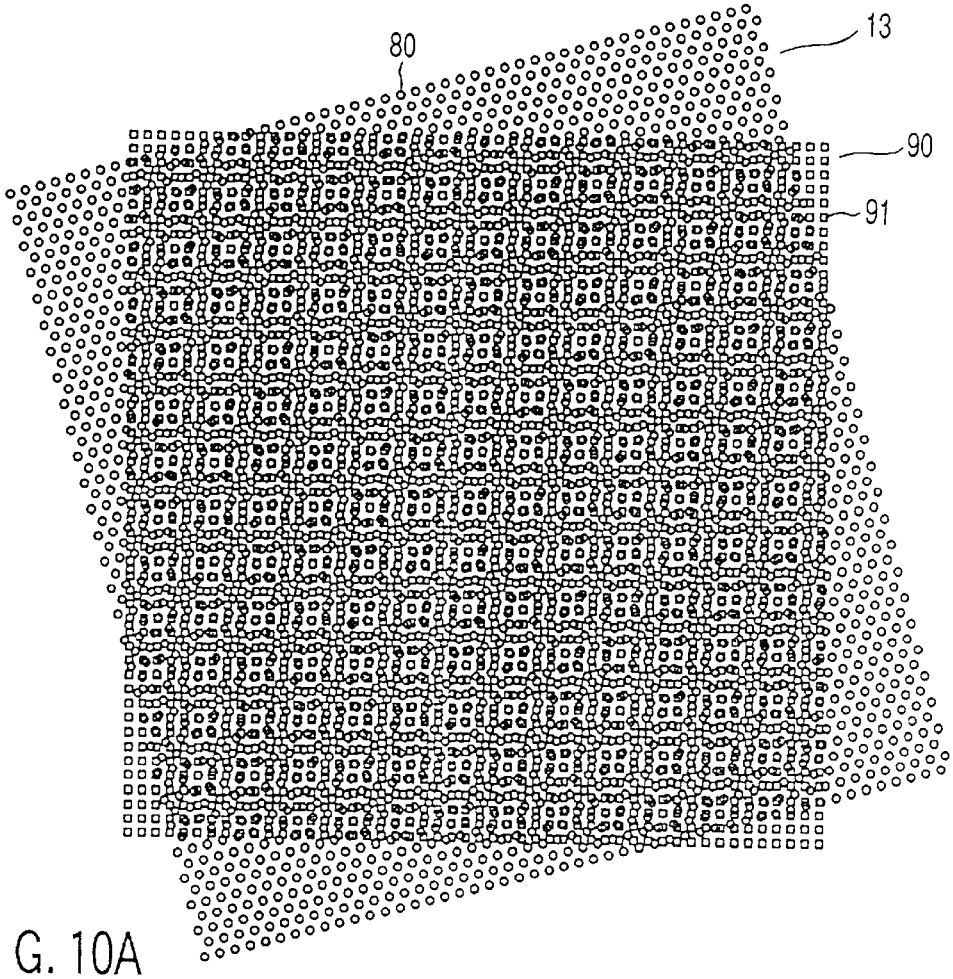
FIGS. 10A and 10B are diagrammatic views showing an example of a combination of an array of through holes in the electron multiplier and array pattern of pixels of a CCD sensor which is obtained by stacking the electron multiplier and CCD sensor shown in FIGS. 9A and 9B.
Figure 10B:
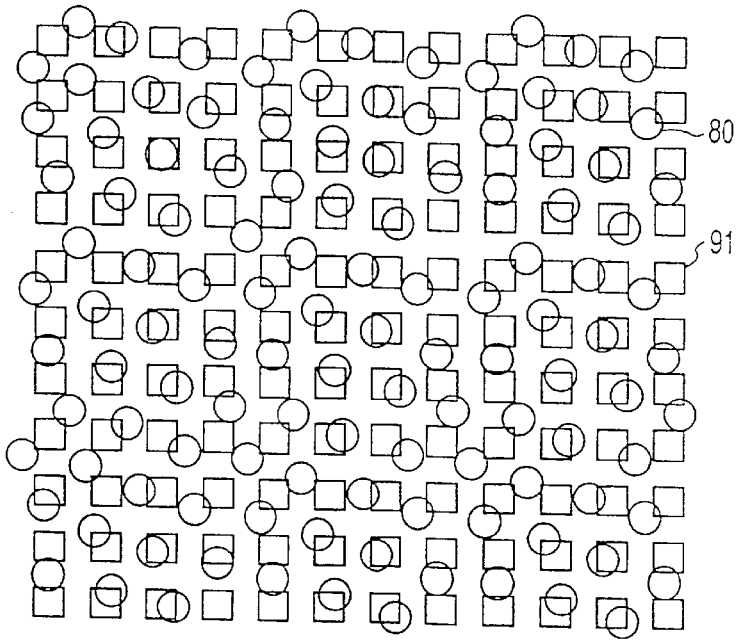

FIGS. 10A and 10B which is partially enlarged view for explaining the feature of the electron multiplier 13 as shown in FIG. 10A show a state satisfying the above-mentioned condition under which the through holes 80 in the electron multiplier 13 are provided and so arranged as to make a predetermined angle with respect to the CCD sensor 90, and diagrammatic views showing a result of simulating a state defined as including a state such that an angle between a line segment connecting the two through holes in the electron multiplier 13 given by a right triangle array ⌈a⌋ as shown in FIG. 9A and a line segment connecting respective pixels 91 of the CCD sensor 90 given by a generally square array ⌈b⌋ as shown in FIG. 9B is 15°.

By stacking the CCD sensor 90 having a CCD sensor 91 having pixels 91 arranged as the square lattice ⌈b⌋ and electron multiplier 13 having through holes 80 arranged as the right triangle ⌈a⌋ in such a way as to include a state in which an angle made between the line segment connecting the through holes 80 and the line segment connecting the pixels is 15° as shown in FIGS. 10A and 10B, it is recognized that the moire fringes can be reduced. In this structure, the intervals of the moire fringes in the mutually orthogonal two directions are matched and it is possible to obtain a uniform image quality over the whole image. Since even the output image pattern produced by the overlapping of the through holes 80 and pixels 91 involves a repetition in a narrower range, readier correction is ensured at an image processing time following the picking up of an image.

Figure 11A:
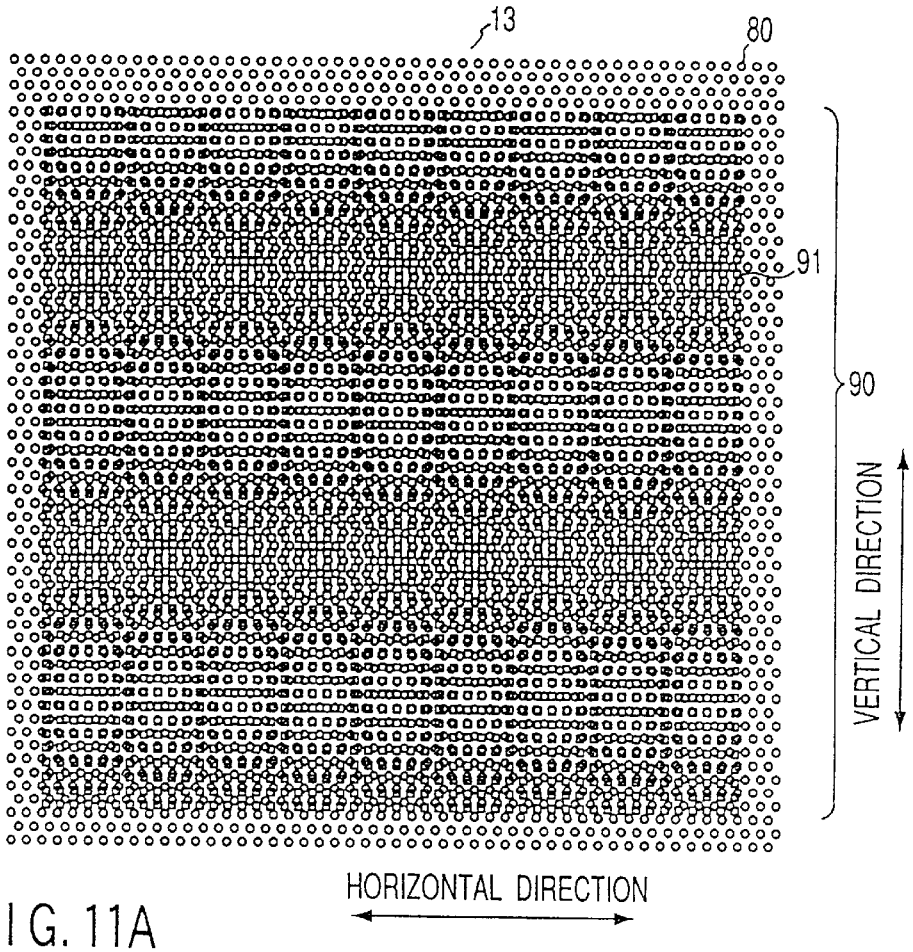
FIGS. 11A and 11B are diagrammatic views showing another example of a combination of an array of through holes in an electron multiplier and array pattern of pixels of a CCD sensor which is obtained by stacking the CCD sensor and electron multiplier shown in FIGS. 9A and 9B.
Figure 11B:
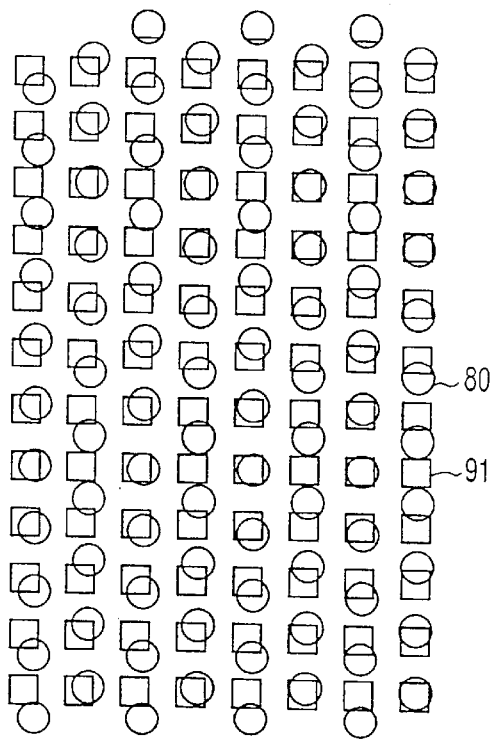

FIGS. 11A and 11B which is a partially enlarged view for explaining the feature of the electron multiplier 13 shown in FIG. 11A are diagrammatic views showing an array of through holes 80 in an electron multiplier 13 different from the electron multiplier shown in FIGS. 10A and 10B and array of pixels 91 of the CCD sensor 90 which satisfy the above-mentioned condition. As shown in FIGS. 11A and 11B, the line segment connecting two through holes 80 in the electron multiplier 13 and given a generally square array and line segment connecting the respective pixels 91 of the CCD sensor 90 and given a generally square array are so defined as being a state including a state such that the line segment connecting the through holes 80 and line segment connecting the pixels 91, that is, two line segments, make an angle of 30° (two line segments are overlapped), in which minute moire fringes are generated in a horizontal direction of a paper sheet which is a first direction and moire fringes of a greater interval are generated in a vertical direction of the paper sheet which is a second direction orthogonal to the first direction. That is, it is recognized that the uniformity of the image is higher in the horizontal direction than in the vertical direction. In this case, an advantage is obtained by utilizing it in the environment under which a horizontal resolution is heightened. In actuality, ordinary image pick-up elements are such that many are lower in a horizontal resolution than a vertical resolution. It is, therefore, possible to improve the uniformity of an image by improving the horizontal resolution.

Figure 12A:
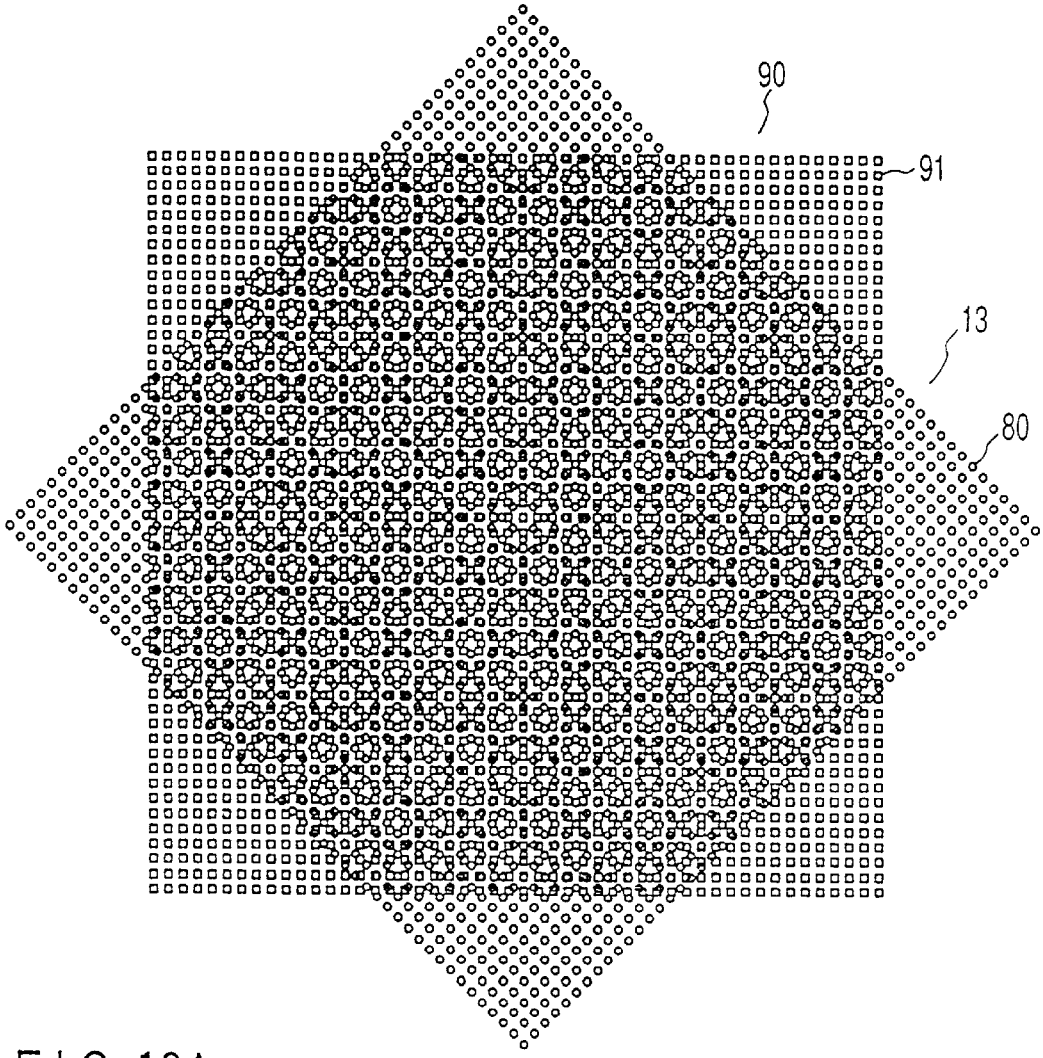
FIGS. 12A and 12B are diagrammatic views showing another example of a combination of array of through holes in an electron multiplier and array pattern of pixels of a CCD sensor which is obtained by stacking the electron multiplier and CCD sensor shown in FIGS. 9A and 9B.
Figure 12B:
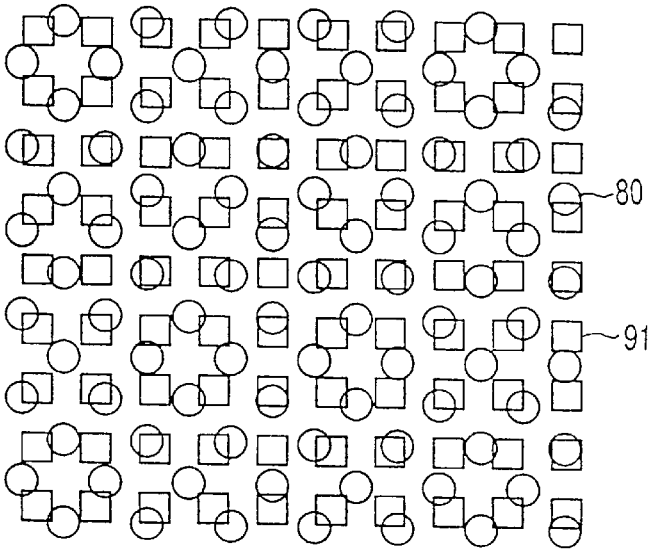

FIGS. 12A and 12B which is a partial enlarged view for explaining the characteristic of the electron multiplier 13 shown in FIG. 12A are diagrammatic views for explaining another example different from that in terms of the array of through holes in the electron multiplier 13 as shown in FIGS. 10A and 10B and FIGS. 11A and 11B and show a result of simulating a state defined as including a state such that the array of the pixels 91 of the CCD sensor 90 has a nearly square shape and an angle of any two of the segment line connecting the through holes 80 in an electron multiplier 13 and line segment connecting the pixels 91 of a CCD sensor 90 is 45°.

As shown in FIGS. 12A and 12B, the CCD sensor 90 having pixels 91 arranged in a square lattice-like array and electron multiplier 13 having through holes 80 similarly arranged in a square lattice-like array are so overlapped as including a state such that an angle between any segments of a line segment connecting the through holes 80 and line segment connecting the pixels 91 is 45° and, by doing so, the through holes 80 in the electron multiplier 13 are decreased in terms of their density in comparison with a close-packed array but the moire fringes can be made very small and it is possible to improve an image quality involved. In this arrangement, a repetition is generated, in a narrower range, in an output image pattern created by the overlapping of the through holes 80 and pixels 91. Readier correction is ensured at the image processing time after the image is picked up.

INDUSTRIAL APPLICABILITY

As explained as set out above, according to the present invention, an X-ray image detector is provided which, by taking a projected visible light image on an output window in a divided way by a plurality of image pick-up elements, can reduce a spacing required for an optical lens to pick up the visible light image and reduce a size of an apparatus as a whole.

Further, it is not necessary to use any expensive optical lens capable of picking up a visible light image of a greater area without being deformed and it is possible to reduce a cost of the X-ray image detector.

Further, a ray image detector is obtained which can readily prepare an electron multiplier of a greater area and make an apparatus larger in size and obtain an output image of less deformation and less noise.

It is also possible to reduce an electric field intensity between the electron multiplier and the photoelectric screen and prevent a deterioration of an image quality resulting from a discharge.

Still further it is possible to suppress a lowering of an image quality created when an output image is picked up.

What is claimed is:

1. An X-ray image detector comprising a vacuum container holding a vacuum therein;

an input fluorescent screen arranged in the vacuum container and converting an X-ray which is incident from an outside to fluorescent light;

an output fluorescent screen arranged in the vacuum container and generating a visible light image by an electron accelerated under an electric field;

a metal layer stacked on the output fluorescent screen;

an output window holding the output fluorescent screen and allowing the visible light image to pass therethrough;

and wherein the input fluorescent screen and output fluorescent screen are arranged parallel to each other while maintaining a predetermined spacing;

an electron multiplier is arranged between the input fluorescent screen and the output fluorescent screen, the electron multiplier has a plurality of metal plates of a predetermined thickness having a plurality of through holes opened and a plurality of insulating materials having gaps to allow a photo-electron from the through hole to pass therethrough are alternately stacked; and image pick-up element is arranged in a position allowing a visible light image from the output fluorescent screen to be received past the output window and takes, as a video image, image information which is output to the output window.

2. An X-ray image detector according to claim 1, wherein the insulating material is made from any of glass, ceramics or photosensitive organic film.

3. An X-ray image detector according to claim 1, wherein the insulating material is made from a plurality of glass beads.

4. An X-ray image detector according to claim 1, wherein the metal plate and insulating material are joined by frit glass.

5. An X-ray image detector according to claim 1, wherein an insulating material is coated on an area of the metal plate facing the input fluorescent screen side.

6. An X-ray image detector according to claim 5, wherein an insulating material is coated on the through holes in the metal plate which face the input fluorescent screen side.

7. An X-ray image detector according to claim 1, wherein an insulating material is coated on an area of the metal plate which faces the output fluorescent screen side.

8. An X-ray image detector according to claim 7, wherein an insulating material is coated on the through holes in the metal plate which face an output fluorescent screen side.

9. An X-ray image detector according to claim 1, wherein an insulating material is coated on an area of the metal plate which faces the input fluorescent screen side and on an area of the metal plate which faces the output fluorescent screen side.

10. An X-ray image detector according to claim 9, wherein an insulating material is coated on the through holes in the metal plate which face the input fluorescent screen side and on the through holes in the metal plate which face the output fluorescent screen side.

11. An X-ray image detector according to claim 2, wherein the through holes in the metal plates has diameters differ in cross-sectional at any position in a thickness direction and are formed to have a circular arc-like or a straight line-like in cross-section in the thickness directions.

12. An X-ray image detector according to claim 11, wherein the metal plates facing the input fluorescent screen side and the output fluorescent screen side have the through holes whose diameters differ in the thickness direction to provide larger diameter hole side faces and smaller diameter hole side faces, the larger diameter hole side face and associated larger diameter hole side face are connected together, an insulating layer is formed on the smaller diameter hole side face and the insulating layer is connected to the insulating material.

13. An X-ray image detector according to claim 12, wherein the large diameter hole side face of the metal plates face the input fluorescent screen and output fluorescent screen.

14. An X-ray image detector according to claim 11, wherein an insulating layer is formed in a whole axial circumferential surface of the through holes in the metal plate.

15. An X-ray image detector according to claim 11, wherein the through holes in the metal plate are formed continuous with corresponding gaps in the insulating material.

16. An X-ray image detector according to claim 1, wherein the metal plates are stacked in one or a two-combined unit over the insulating layer, and the metal plate nearest to the input fluorescent screen side and metal plate nearest to the output fluorescent screen side are each arranged in only one unit.

17. An X-ray image detector according to claim 1, wherein the metal plates are stacked over the insulating material in one or a two-combined unit and the metal plate nearest to the input fluorescent screen side and metal plate located at a second position from the output fluorescent screen side are each arranged in only one unit.

18. An X-ray image detector according to claim 1, wherein a visible light image from the output fluorescent screen is picked up by a plurality of image pick-up elements.

19. An X-ray image detector according to claim 18, wherein those respective areas picked up by the plurality of image pick-up areas are mutually partially overlapped.

20. An X-ray image detector according to claim 18, further comprising an image correction section having at least one of a position correction circuit for correcting an image position of overlapped areas of respective image signals obtained from the plurality of image pick-up elements, a luminance correction circuit for correcting the luminance of the overlapped areas of the image signals and an elimination circuit for eliminating a signal corresponding to an unnecessary portion of the image signals, and eliminating an overlapped image or discontinuous image.

21. An X-ray image detector according to claim 1, wherein a plurality of insulating spheres are arranged on either of the input fluorescent screen and output fluorescent screen of the electron multiplier.

22. An X-ray image detector according to claim 1, wherein, in a position where a visible light image from the output fluorescent screen is received past the output window, a plurality of image pick-up elements for taking out picked-up image information as a video signal are arranged, and wherein, in the image pick-up element, an array of pixels constituting an image signal is given, on a two-dimensional plane, as a square array made from right squares and, in the electron multiplier, an array of the through holes is given, on a two-dimensional plane, as a closest packed array comprised of right squares, and wherein the direction of a line segment mutually connecting the adjacent through holes in the electron multiplier provides a matched combination relative to a line segment connecting adjacent pixels in the image pick-up element.

23. An X-ray image detector according to claim 1, wherein, in a position where a visible light image from the output fluorescent screen is received past the output window, a plurality of image pick-up elements for taking out picked-up image information as a video signal are arranged, and wherein, in the image pick-up element, an array of pixels constituting an image signal is given, on a two-dimensional plane, as a square array made from right squares and, in the electron multiplier, an array of the through holes is given, on a two-dimensional plane, as a closest packed array comprised of right triangles, and wherein the direction of a line segment connecting the adjacent through holes in the electron multiplier relative to a line segment connecting adjacent pixels of the image pick-up element includes a combination having an angle of 15° with respect to the line segment connecting the adjacent pixel.

24. An X-ray image detector according to claim 1, wherein, in a position where a visible light image from the output fluorescent screen is received past the output window, a plurality of image pick-up elements for taking out picked-up image information as a video signal are arranged, and wherein, an array of pixels constituting an image in the image pick-up elements and through holes in the electron multiplier provide a square array made from right squares on a two-dimensional plane, and wherein the direction of a line segment connecting adjacent through holes in the electron multiplier relative to a line segment connecting adjacent pixels of the image pick-up element includes a combination having an angle of 45° with respect to the line segment connecting the adjacent pixels.

* * * * *